US007806950B2

(12) United States Patent
Han et al.

(10) Patent No.: US 7,806,950 B2
(45) Date of Patent: Oct. 5, 2010

(54) DUST SEPARATING APPARATUS OF VACUUM CLEANER

(75) Inventors: Jung-gyun Han, Gwangju (KR); Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 450 days.

(21) Appl. No.: 11/976,107

(22) Filed: Oct. 22, 2007

(65) Prior Publication Data

US 2008/0223010 A1 Sep. 18, 2008

(30) Foreign Application Priority Data

Mar. 12, 2007 (KR) ..... 10-2007-0023959

(51) Int. Cl.
*B01D 45/12* (2006.01)

(52) U.S. Cl. ..... 55/345; 55/429; 55/DIG. 3

(58) Field of Classification Search ..... 55/345, 55/429, 456, 459.1, DIG. 3
See application file for complete search history.

(56) References Cited

U.S. PATENT DOCUMENTS

| | | | |
|---|---|---|---|
| 1,897,195 | A | 2/1933 | Peter Howden |
| 6,485,536 | B1 | 11/2002 | Masters |

FOREIGN PATENT DOCUMENTS

| | | |
|---|---|---|
| DE | 101 10 581 | 11/2001 |
| EP | 0 728 435 | 8/1996 |
| EP | 1 676 516 | 7/2006 |
| EP | 1 776 910 | 4/2007 |
| GB | 2 362 341 | 11/2001 |
| JP | 2002 326041 | 11/2002 |
| JP | 2002-326041 | 12/2002 |
| KR | 2001/0104810 | 11/2001 |
| KR | 1020020071045 | 9/2002 |

*Primary Examiner*—Robert A Hopkins
(74) *Attorney, Agent, or Firm*—Blank Rome LLP

(57) ABSTRACT

A dust separating apparatus of a vacuum cleaner includes cyclone units connected such that air passes from one cyclone unit to another cyclone unit in sequence. Each of the cyclone units receives air, swirl the air, and separate dust from the air. The cyclone units are placed within another cyclone unit from which it receives the air.

19 Claims, 8 Drawing Sheets

DUST SEPARATING APPARATUS OF VACUUM CLEANER

CROSS-REFERENCES TO RELATED APPLICATIONS

This application claims priority under 35 U.S.C. §119 from Korean Patent Application No. 10-2007-0023959, filed on Mar. 12, 2007, in the Korean Intellectual Property Office, the disclosure of which is incorporated herein by reference in its entirety.

This application may be related to the copending U.S. patent application Ser. No. 10/840,231, filed May 7, 2004 entitled "Cyclone Dust Separating Apparatus and Vacuum Cleaner Having the Same" by Jang-Keun Oh et al., the entire disclosure of which is incorporated herein by reference.

This application may be related to the copending U.S. patent application Ser. No. 10/851,114, filed May 24, 2004 entitled "Cyclone Dust Collecting Device for Vacuum Cleaner" by Jang-Keun Oh et al., the entire disclosure of which is incorporated herein by reference.

This application may be related to the copending U.S. patent application Ser. No. 10/874,257, filed Jun. 24, 2004 entitled "Cyclone Dust Collecting Apparatus for a Vacuum Cleaner" by Jang-Keun Oh et al., the entire disclosure of which is incorporated herein by reference.

This application may be related to the copending U.S. patent application Ser. No. 11/137,506, filed May 26, 2005 entitled "Vacuum Cleaner Dust Collecting Apparatus" by Jung-Gyun Han et al., the entire disclosure of which is incorporated herein by reference.

This application may be related to the copending U.S. patent application Ser. No. 11/206,878, filed Aug. 19, 2005 entitled "Dust Collecting Apparatus of a Vacuum Cleaner" by Ji-Won Seo et al., the entire disclosure of which is incorporated herein by reference.

This application may be related to the copending U.S. patent application Ser. No. 11/203,990, filed Aug. 16, 2005 entitled "Dust-Collecting Apparatus and Method for a Vacuum Cleaner" by Ji-Won Seo et al., the entire disclosure of which is incorporated herein by reference.

This application may be related to the copending U.S. patent application Ser. No. 11/281,732, filed Nov. 18, 2005 entitled "Dust Collecting Apparatus for a Vacuum Cleaner" by Jung-Gyun Han et al., the entire disclosure of which is incorporated herein by reference.

This application may be related to the copending U.S. patent application Ser. No. 11/315,335, filed Dec. 23, 2005 entitled "Multi-Cyclone Dust Separating Apparatus" by Dong-Yun Lee et al., the entire disclosure of which is incorporated herein by reference.

This application may be related to the U.S. Pat. No. 7,097,680, granted Aug. 29, 2006 entitled "Cyclone Separating Apparatus and Vacuum Cleaner Equipped with the Same" by Jang-Keun Oh, the entire disclosure of which is incorporated herein by reference.

FIELD OF THE INVENTION

The present invention relates to a dust separating apparatus for a vacuum cleaner. In particular, the present invention relates to a dust separating apparatus which separates dust from air and is more compact than conventional apparatuses.

BACKGROUND OF THE INVENTION

A dust separating apparatus draws in air and separates any dust from the air. The term "dust" will be used herein to collectively refer to dust, dirt, particulates, and other similar materials. Dust separating apparatuses generally comprise one cyclone unit, such as disclosed in U.S. Pat. No. 964,428 to Johnson et al. Multi-cyclone units separate finer dust to improve dust collecting efficiency, and examples thereof can be found in GB344421; U.S. Pat. No. 2,553,175 to Davenport et al.; and U.S. Pat. No. 3,682,302 to Bernutat.

Multi-cyclone units are typically used for industrial cleaners, however, and not for home use because of its large volume. Accordingly, dust separating apparatuses have been developed, which can provide improved dust collecting efficiency and which are compact enough to be mounted in a small sized vacuum cleaner. For example, in Korean Patent Publication No. 437156, which is related to U.S. Pat. No. 6,546,593 to Oh et al., the inventor of the present invention discloses two cyclone units connected in series on the same plane so that a first cyclone unit encloses a second cyclone unit and therefore decreases the size of the dust separating apparatus. The disclosed arrangement of cyclone units is compact and can be applied to a vacuum cleaner for home use. Also, cyclone units in series provide improved dust collecting efficiency by collecting dust in two stages. Also, as described in WO 02/067753, a multi-cyclone dust separating apparatus to improve dust collecting efficiency comprises a first cyclone unit and a plurality of second cyclone units which are connected in parallel. Large dust is separated in the first cyclone unit, and fine dust is separated in the plurality of second cyclone units.

However, the volume and height of these conventional dust separating apparatuses are still relatively large. The conventional apparatuses can be generally applied to a large-sized upright vacuum cleaner but cannot be applied to a canister type vacuum cleaner. The conventional dust separating apparatuses comprise a plurality of cyclone units, but the plurality of cyclone units are difficult to arrange in series beyond three stages, without compromising compactness. Additionally, to empty the conventional dust collecting apparatus, the entire apparatus must be moved which inconveniences the user.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a dust separating apparatus of vacuum cleaner of a compact size which separates air in multiple stages in series to improve dust collecting efficiency. The present invention can be applied to a canister-type vacuum cleaner as well as an upright vacuum cleaner.

One embodiment of the present invention provides a dust separating apparatus of a vacuum cleaner. The dust separating apparatus includes a plurality of cyclone units, the plurality of cyclone units being coupled such that air passes from one cyclone unit to another cyclone unit in sequence, each of the plurality of cyclone units adapted to receive air, swirl the air, and separate dust from the air, wherein each of the plurality of cyclone units is configured to be disposed within another cyclone unit from which it receives the air.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Certain exemplary embodiments of the present invention will now be described in greater detail with reference to the accompanying drawings.

Stating that the plurality of cyclone units are connected "in series" will herein mean that the plurality of cyclone units are connected in a manner such that air passes from one cyclone unit to another cyclone unit in sequence. Stating that the plurality of cyclone units are connected "in parallel" means that air is dispersed to many cyclone units at the same time and discharged from those cyclone units largely simultaneously.

Figure 1:
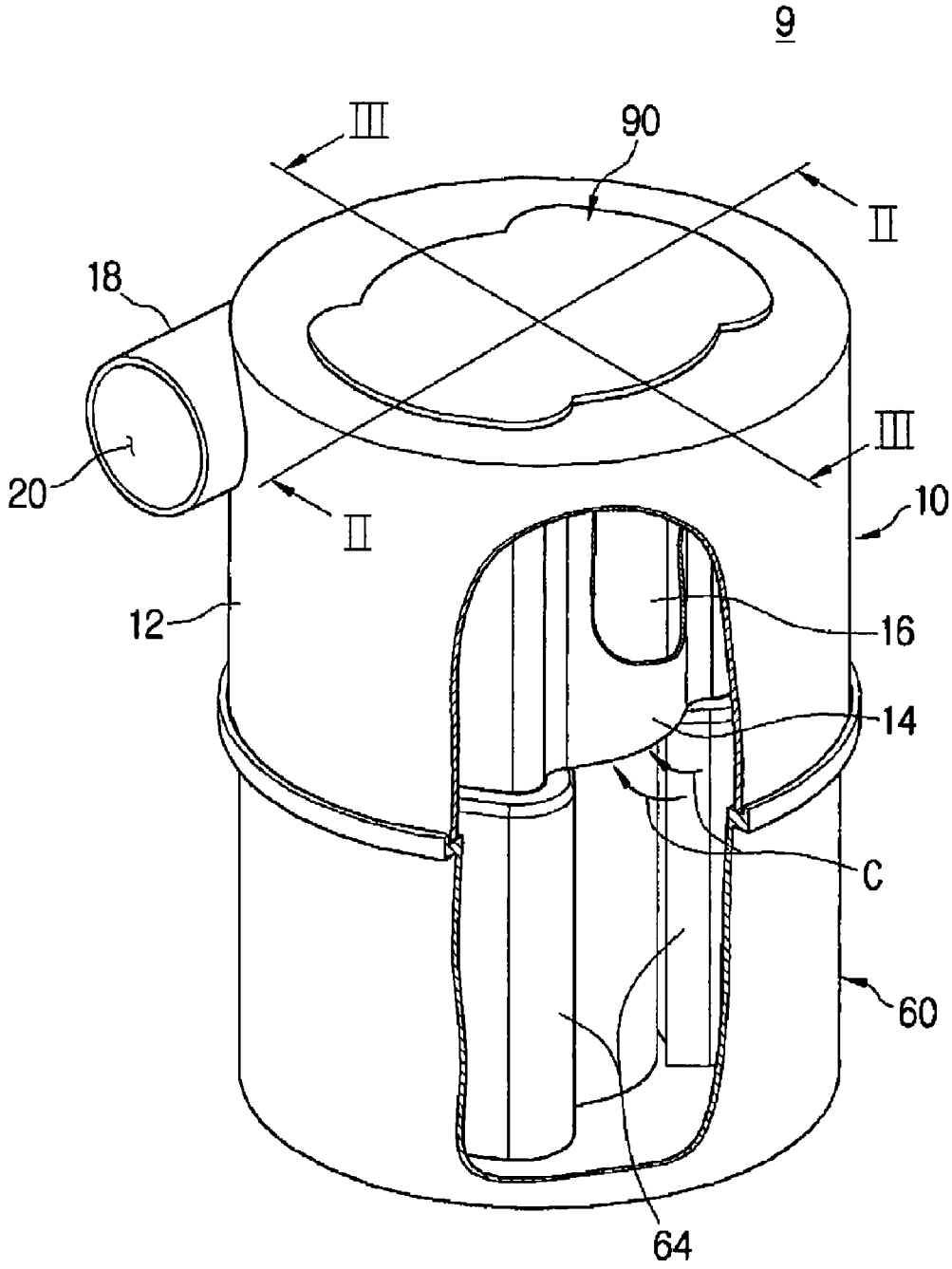
FIG. 1 is a perspective view of a dust separating apparatus of a vacuum cleaner according to an exemplary embodiment of the present invention showing a portion removed.

Referring to FIG. 1, a dust separating apparatus 9 of a vacuum cleaner according to an exemplary embodiment of the present invention may comprise a cyclone portion 10, a first cyclone unit 12, a second cyclone unit 14, a third cyclone unit 16, a dust receptacle 60, and a cover portion 90. The first cyclone unit 12 may be disposed around the second cyclone unit 14, and the second cyclone unit 14 may be disposed around a part of the third cyclone unit 16. The cyclone portion 10, the dust receptacle 60, and the cover portion 90 may be separately formed. The cyclone portion 10 may include an air inlet pipe 18 with a first inlet 30. The first inlet 30 may be formed to introduce air in a tangential direction to the first cyclone unit 12 through the air inlet pipe 18. The dust receptacle 60 may include a second dust receptacle body 64.

Figure 2:
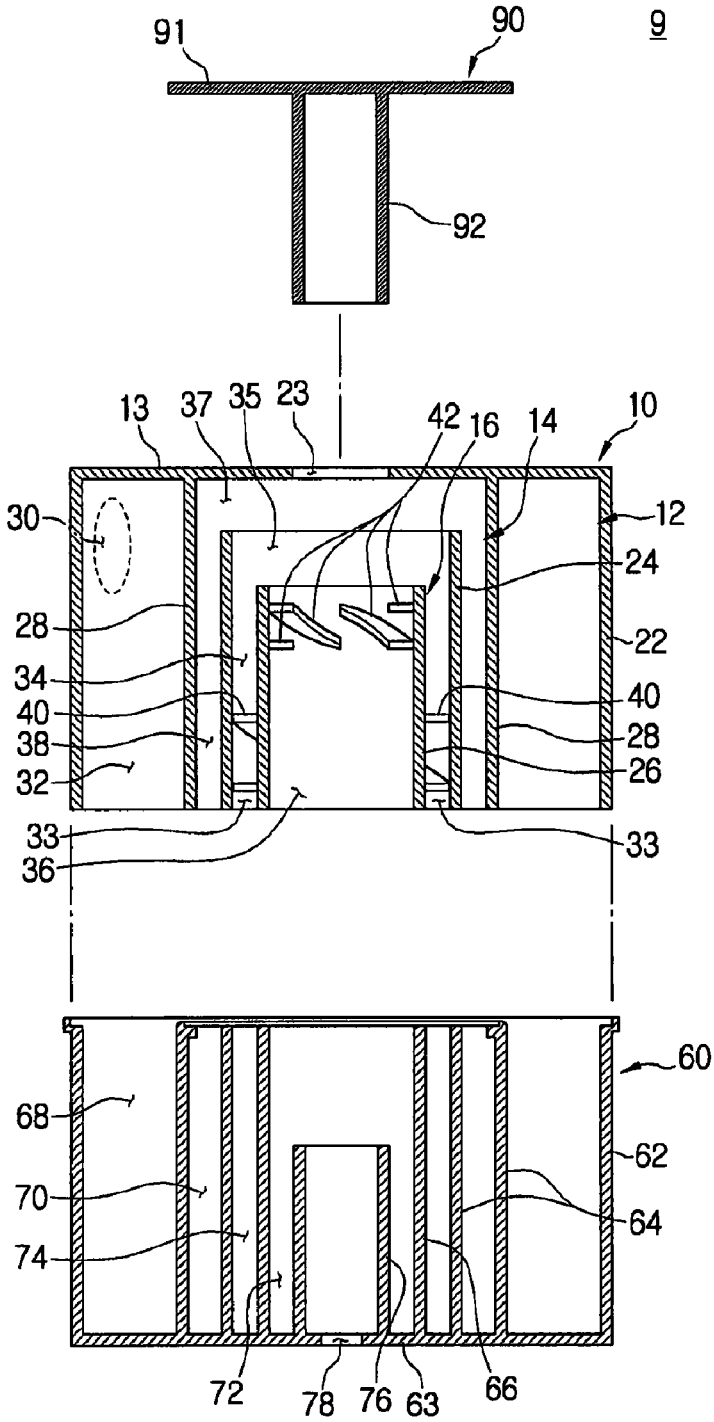
FIG. 2 is an exploded sectional view along line II-II of the dust separating apparatus illustrated in FIG. 1.
Figure 3:
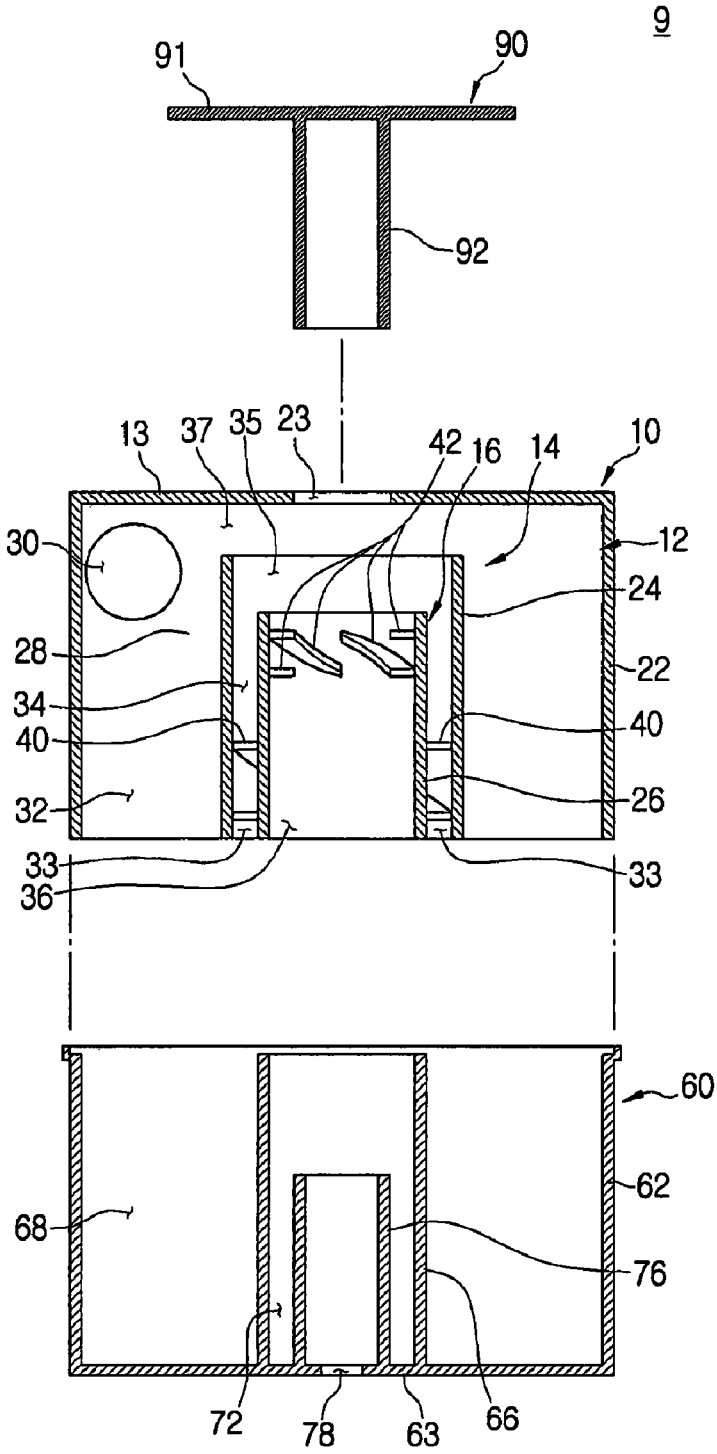
FIG. 3 is an exploded sectional view along line III-III of the dust separating apparatus illustrated in FIG. 1.

Referring to FIGS. 2 and 3, the cyclone portion 10 may include the first cyclone unit 12, the second cyclone unit 14, the third cyclone unit 16, an upper wall 13, a partition 28, a dust passage 38, a first guide member 40, and a second guide member 42. The first cyclone unit 12, the second cyclone unit 14, and the third cyclone unit 16 may have different heights with respect to each other. The first cyclone unit 12, the second cyclone unit 14, and the third cyclone unit 16 may be disposed on substantially the same plane with respect to each other.

The first cyclone unit 12 may include a first cyclone body 22, a first cyclone chamber 32, the first inlet 30, and a first flow path 33. The first cyclone chamber 32 may be formed between the first cyclone body 22 and the partition 28. The first cyclone body 22 may be connected with the upper wall 13. The partition 28 may also be connected to the upper wall 13. Air flowing through the first inlet 30 may rotate in the first cyclone chamber 32 so that dust can be separated from the air. The first inlet 30 may be formed to introduce air in a tangential direction to the first cyclone chamber 32. Air may leave the first cyclone chamber 32 through the first flow path 33. The first flow path 33 may lead air from the first cyclone unit 12 to the second cyclone unit 14, thus the first flow path 33 provides simultaneously a first outlet for the first cyclone unit 12 and a second inlet for the second cyclone unit 14.

The second cyclone unit 14 may include a second cyclone body 24, a second cyclone chamber 34, the first flow path 33, and a second flow path 35. The second cyclone body 24 may be disposed within the first cyclone body 22. The second cyclone chamber 34 may be formed between the second cyclone body 24 and the third cyclone body 26 which will be explained below. Air may enter the second cyclone chamber 34 from the first flow path 33. The first flow path 33 may be formed between an interior wall of the second cyclone body 24 and an exterior wall of the third cyclone body 26 which will be explained below. The first guide members 40 may guide air climbing through the first flow path 33 to swirl in the second cyclone chamber 34. The first guide member 40 may be arranged in a substantially spiral form. The first guide member 40 may be connected to both the second cyclone body 24 and the third cyclone body 26. Air rotates in the second cyclone chamber 34 so that dust can be separated from the air. The air may then leave the second cyclone chamber 34 through the second flow path 35, thus the second flow 35 may provide a second outlet for the second cyclone unit 14 and a third inlet for the third cyclone unit 16. The second flow path 35 may be formed as an interval between the upper wall 13 of the cyclone portion 10 and an upper portion of the third cyclone body 26.

The dust passage 38 may be formed between the second cyclone body 24 and the partition 28. The dust passage 38 may guide dust from the second cyclone chamber 34 through a dust discharge space 37 to a second dust collecting chamber 70.

The third cyclone unit 16 may include the third cyclone body 26, a third cyclone chamber 36, the second flow path 35, a third outlet 78, and a second guide member 42. The third cyclone body 26 may be disposed within the second cyclone body 24. The third cyclone chamber 36 may be an inner space of the third cyclone body 26. Air may enter the third cyclone chamber 36 from the second flow path 35. Entering air may rotate due to the second guide member 42. The second guide member 42 may be arranged in a substantially spiral form. The second guide member 42 may be disposed at an interior surface of the third cyclone body 26. Air may rotate in the third cyclone chamber 36 so that dust can be separated from the air. The third outlet 78 may be disposed at a lower wall 63 of the dust receptacle 60.

An opening 23 may be formed in the upper wall 13 to receive a cover portion 90. The cover portion 90 may include a board member 91 and a center pipe 92. The center pipe 92 may protrude from a lower portion of the board member 91. The center pipe 90 may be inserted into the opening 23 of the cyclone portion 10. The board member 91 and the center pipe 92 may be formed integrally with each other. The cover portion 90 may be formed by injection molding.

The dust receptacle 60 may include a first dust receptacle body 62, a second dust receptacle body 64, a third dust receptacle body 66, a discharge pipe 76, a first dust collecting chamber 68, the second dust collecting chamber 70, a third dust collecting chamber 72, and the lower wall 63. Respective bottoms of the first dust receptacle body 62, the second dust receptacle body 64, and the third dust receptacle body 66 may be connected to the lower wall 63. The dust receptacle bodies 62, 64, and 66 may be formed integrally with the lower wall 63. The dust receptacle bodies 62, 64, and 66 may be formed with the lower wall 63 by injection molding.

The first dust receptacle body 62 may form an exterior of the dust receptacle 60. The first dust receptacle body 62 may be coupled to a bottom of the first cyclone body 22. The first dust collecting chamber 68 may be formed between the first dust receptacle body 62 and the second dust receptacle body 64. The first dust collecting chamber 68 may collect dust separated by the first cyclone chamber 32.

The second dust receptacle body 64 may be disposed within the first dust receptacle body 62. The second dust receptacle body 64 may be coupled with a bottom of the second cyclone body 24. The second dust receptacle body 64 may be formed as a plurality of separate second dust receptacle bodies 64 with a space 74 formed in the interval between the second dust receptacle bodies 64. The second dust collecting chamber 70 may be disposed within the second dust receptacle body 64. The second dust collecting chamber 70 may collect dust from the second cyclone chamber 34.

The third dust receptacle body 66 may be substantially disposed within the second dust receptacle body 64. The plurality of second dust receptacle bodies 64 may be arranged to partially enclose the third dust receptacle body 66. The third dust receptacle body 66 may be coupled with a bottom of the third cyclone body 26. The third dust receptacle body 66 may enclose the discharge pipe 76. The third dust collecting chamber 72 may be defined between the third dust receptacle body 66 and the discharge pipe 76. The third dust collecting chamber 70 may collect dust from the third cyclone chamber 36.

Figure 4:
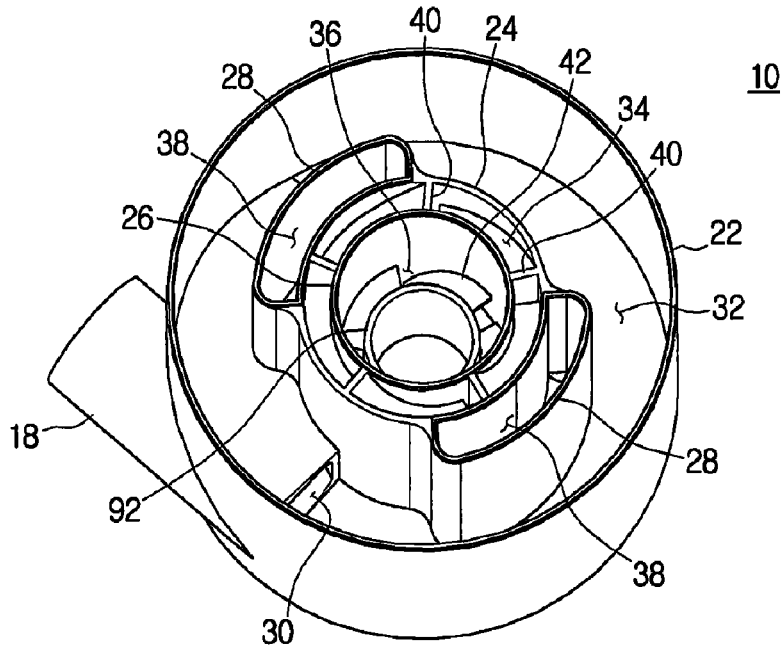
FIG. 4 is a bottom perspective view illustrating a cyclone unit of the dust separating apparatus illustrated in FIG. 1.

Referring to FIG. 4, the first cyclone body 22 may be formed in a substantially cylindrical shape. The air inlet pipe 18 may protrude in the tangential direction to the first cyclone body 22. Within the first cyclone body 22, the second cyclone body 24 may be formed in a substantially cylindrical shape. The first guide members 40 may be formed in a circumferential direction on the interior wall of the second cyclone body 24. The number of first guide members 40 illustrated is exemplary only and is not intended to be limiting. The optimal number of first guide members 40 may be less or more that the five first guide members 40 depicted in FIG. 4.

The partitions 28 may be disposed substantially symmetrically to the second cyclone body 24. The partitions 28 may be arranged to substantially enclose the second cyclone body 24. In the embodiment depicted, two partitions 28 are shown, but the number of partitions 28 illustrated is exemplary only and is not intended to be limiting. The optimal number of partitions 28 may be less or more that the two partitions 28 depicted in FIG. 4. The partition 28 may define the dust passage 38. The dust passage 38 may couple to the second dust collecting chamber 70 (shown in FIG. 5), thus the dust passage 38 may have a shape substantially corresponding to a shape of the second dust collecting chamber 70 (shown in FIG. 5). The first flow path 33 may be formed between the interior wall of the second cyclone body 24, the exterior wall of the third cyclone body 26, and where the second cyclone body 24 does not engage the inner wall 65 (shown in FIG. 5).

The third cyclone body 26 may be formed in a substantially cylindrical shape. The third cyclone body 26 may be disposed within the second cyclone body 24. The second guide members 42 may be formed in a circumferential direction on the interior wall of the third cyclone body 26. The number of second guide members 42 illustrated is exemplary only and is not intended to be limiting. The optimal number of second guide members 42 may be less or more that the four second guide members 42 depicted in FIG. 4.

Figure 5:
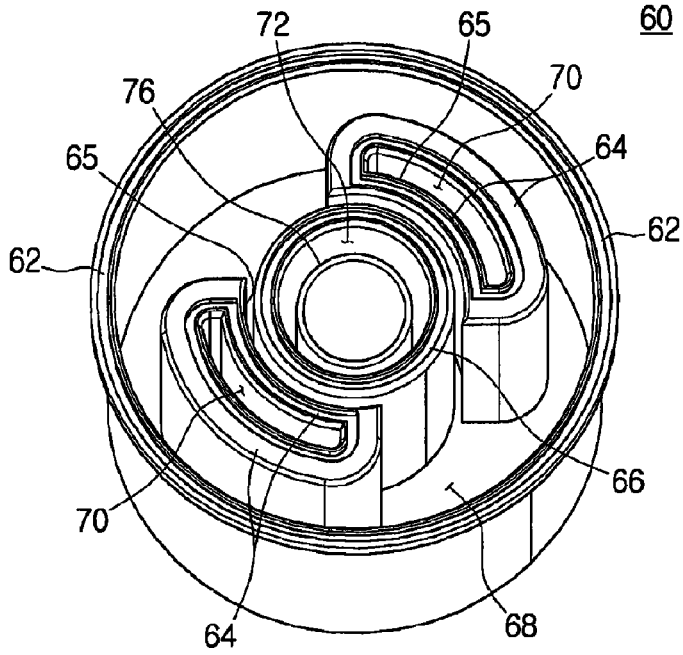
FIG. 5 is a top perspective view illustrating a dust receptacle of the dust separating apparatus illustrated in FIG. 1.

Referring to FIG. 5, the first dust receptacle body 62 may be formed in a substantially cylindrical shape. The second dust receptacle body 64 may be formed in a substantially circular arc shape. Accordingly, because the second dust collecting chamber 70 is formed within the second dust receptacle body 64, the second dust collecting chamber 70 may have a substantially arced rectangular configuration in cross-section. Several second dust receptacle bodies 64 may be placed substantially symmetrically to each other with reference to the third dust receptacle body 66. The second dust receptacle bodies 64 may be arranged with the space 74 (shown in FIG. 2) formed in the interval between the second dust receptacle bodies 64. The second dust receptacle bodies 64 may enclose a part of the exterior of the third dust receptacle body 66. An inner wall 65 of the second dust receptacle bodies 64 may engage with the second cyclone body 24 (shown in FIG. 4).

The third dust receptacle body 66 may be formed in a substantially cylindrical shape. The third dust receptacle 66 may engage the bottom of the third cyclone body 26. The third dust receptacle body 66 may enclose the discharge pipe 76.

Figure 6:
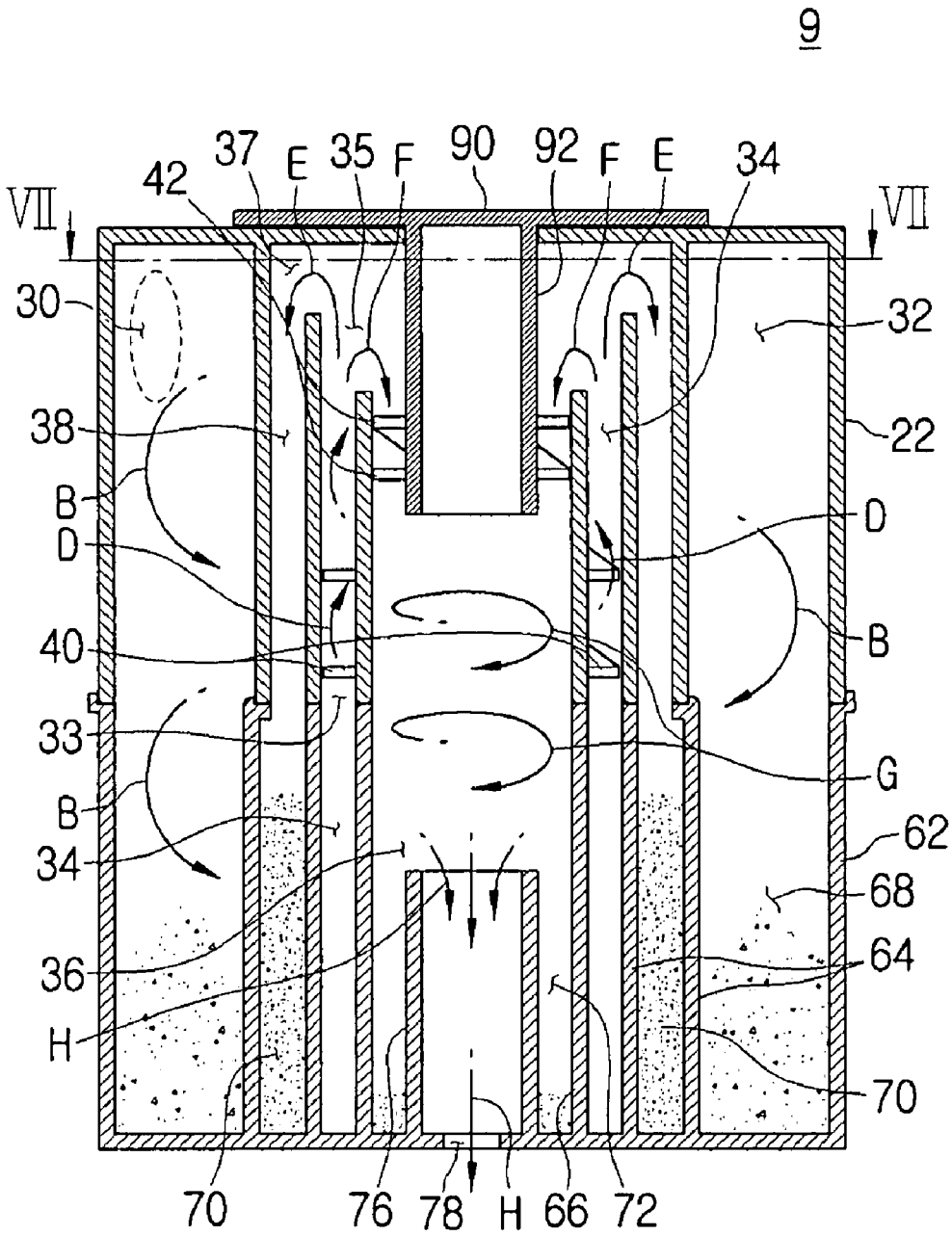
FIG. 6 is a sectional view along line II-II of the dust separating apparatus illustrated in FIG. 1, showing air flow paths.
Figure 7:
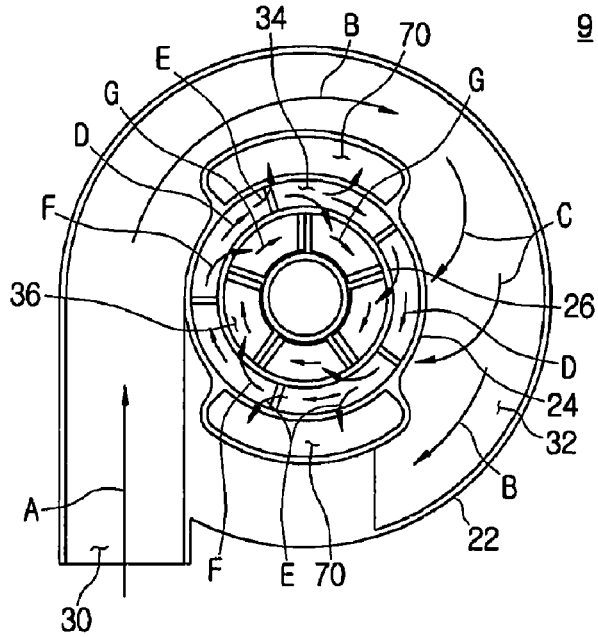
FIG. 7 is a sectional view along the line VII-VII of the dust separating apparatus illustrated in FIG. 6.

The operation of the dust separating apparatus 9 will be explained in detail with reference to FIGS. 6 and 7 according to an exemplary embodiment of the present invention. As indicated by an arrow A (shown in FIG. 7), air containing dust flows through the first inlet 30 formed at the first cyclone body 22. The air swirls along the first cyclone chamber 32, as indicated by an arrow B (shown in FIGS. 6 and 7). Large dust separates from the air and drops into the first dust collecting chamber 68 while the air swirls. The air flows into the second cyclone chamber 34 through the first flow path 33, as indicated by an arrow C (shown in FIGS. 1 and 7). The air swirls along the second cyclone chamber 34 and fine dust separates from the air, while the air is guided by the first guide members 40, as indicated by an arrow D (shown in FIGS. 6 and 7). The separated dust may be discharged through the dust discharge space 37, as indicated by an arrow E (shown in FIGS. 6 and 7). The discharged dust drops into the second dust collecting chamber 70 through the dust passage 38. The air flows back to the third cyclone chamber 36 through the second flow path 35, as indicated by an arrow F (shown in FIGS. 6 and 7). The air is guided by the second guide member 42. The air descends while swirling along the center pipe 92, as indicated by an arrow G (shown in FIG. 6). The fine dust separated from the third cyclone chamber 36 drops into the third dust collecting chamber 72. The air then passes through the outlet pipe 76 and is discharged through the third outlet 78, as indicated by an arrow H (shown in FIG. 6). A user can hold a handle (not shown) which is formed at the exterior of the first dust receptacle body 62. The user can separate the dust receptacle 60 from the cyclone portion 10 to discard the collected dust.

Figure 8:
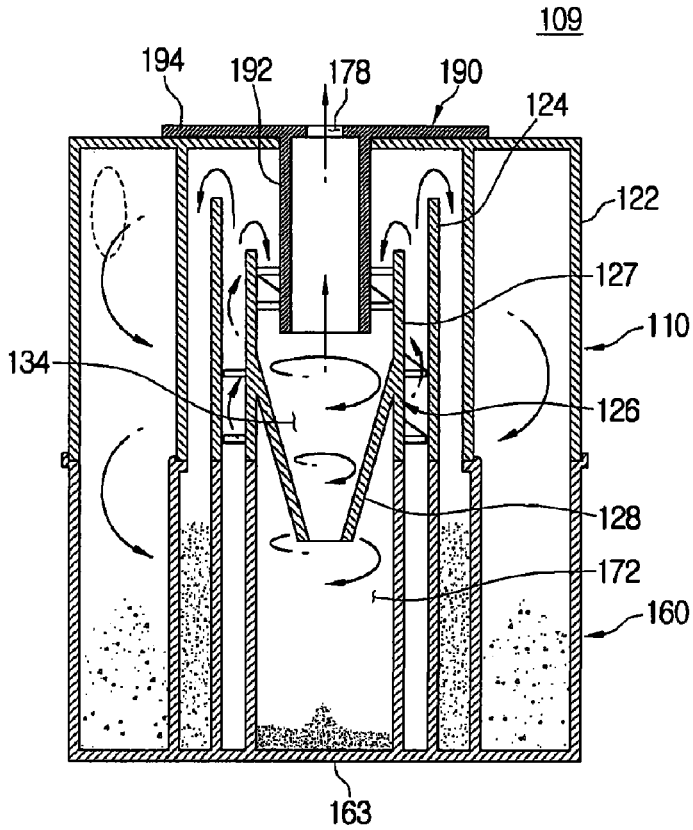
FIG. 8 is a sectional view of a dust separating apparatus of a vacuum cleaner according to another exemplary embodiment of the present invention.

FIG. 8 is a cross-sectional view illustrating a dust separating apparatus 109 of a vacuum cleaner according to another exemplary embodiment of the present invention. As the dust separating apparatus 109 has a similar structure as the dust separating apparatus 9 of the first exemplary embodiment of the present invention, a description of identical portions will be omitted, but portions with a different construction will be described in detail.

A cyclone portion 110 is similar to the cyclone portion 10 of the first exemplary embodiment of the present invention, except for a third cyclone body 126, which is formed in a substantially inverse-conical shape. The third cyclone body 126 may comprise a cylindrical portion 127, and an inverse cone portion 128. The inverse cone portion 128 may protrude from an inner surface of the cylindrical portion 127 in a downward direction with the inverse cone portion 128 at its bottom. The bottom of the inverse cone portion 128 may be inserted into a third dust collecting chamber 172. The third cyclone body 126 may be disposed within the first cyclone body 112 and the second cyclone body 124.

Unlike the dust receptacle 60 of the dust separating apparatus 9 of the first exemplary embodiment, a dust receptacle 160 has no discharge pipe 76 and no third outlet 78 at a lower wall 163. Otherwise, the other components of the dust receptacle 160 are substantially the same as the first exemplary embodiment of the present invention.

A cover portion 190 may include a board member 194 and a third outlet 178. The third outlet 178 may be formed on the board member 194. Thus, air may be discharged to the exterior of the dust separating apparatus 109 through a center pipe 192. The other components of the cover portion 190 are similar to the cover portion 90 of the first exemplary embodiment of the present invention.

Accordingly, swirling force of air in a third cyclone chamber 134 may be maintained downward. Thus, because of the downward force, fine dust contained in the third dust collecting chamber 172 will not substantially flow out through the third outlet 178 along with the discharged air.

Figure 9:
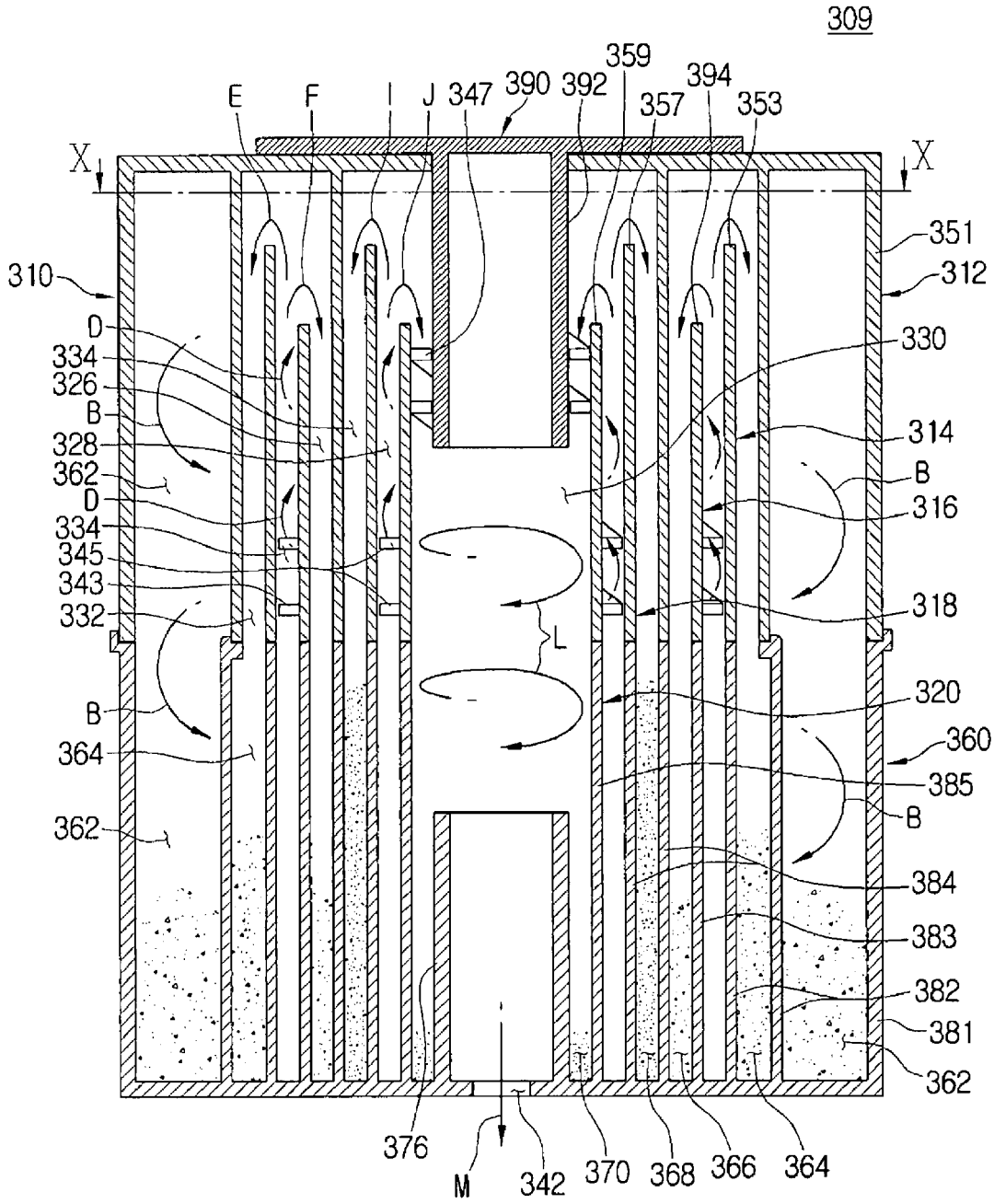
FIG. 9 is a sectional view of a dust separating apparatus of a vacuum cleaner according to yet another exemplary embodiment of the present invention.
Figure 10:
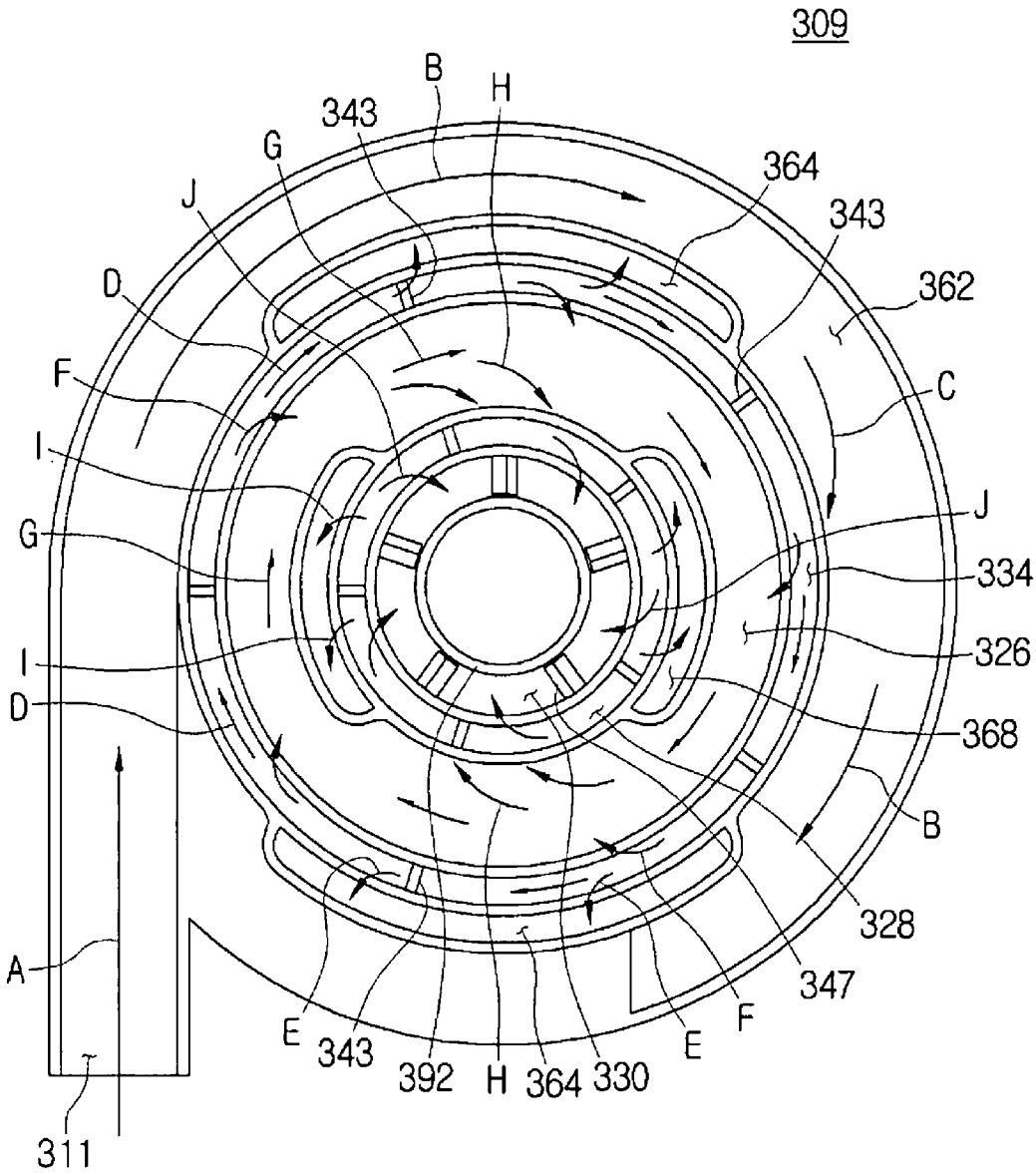
FIG. 10 is a sectional view along line X-X of the dust separating apparatus illustrated in FIG. 9.

FIG. 9 is a cross-sectional view illustrating a dust separating apparatus of a vacuum cleaner according to yet another exemplary embodiment of the present invention, and FIG. 10 is a cross-sectional view cut along line X-X of FIG. 9.

A dust separating apparatus 309 of the third exemplary embodiment of the present invention is similar to the dust separating apparatuses 9 and 109 of the first and second exemplary embodiments of the present invention, but the dust separating apparatus 309 of the third exemplary embodiment includes a fourth cyclone unit 318 and a fifth cyclone unit 320 in addition to a first cyclone unit 312, a second cyclone unit 314, and a third cyclone unit 316. The dust separating apparatus 309 may include a cyclone portion 310, a dust receptacle 360, and a cover portion 390.

The first cyclone unit 312 may include a first cyclone body 351 and a first dust receptacle body 381. The second cyclone unit 314 may include a second cyclone body 353 and a second dust receptacle body 382. The third cyclone unit 316 may include a third cyclone body 394 and a third dust receptacle body 383. The fourth cyclone unit 318 may include a fourth cyclone body 357 and a fourth dust receptacle body 384. The fifth cyclone unit 320 may include a fifth cyclone body 359 and a fifth dust receptacle body 385.

The first cyclone unit 312 may enclose the second cyclone unit 314. The second cyclone unit 314 may partially enclose the third cyclone unit 316. The third cyclone unit 316 may enclose the fourth cyclone unit 318. The fourth cyclone unit 318 may partially enclose the fifth cyclone unit 320.

The first, second, and third cyclone units 312, 314, and 316 of the third exemplary embodiment can correspond to the first, second, and third cyclone units 12, 14, and 16 of the first exemplary embodiment of the present invention. The fourth and fifth cyclone units 318 and 320 may be similar to the second and third cyclone units 314 and 316. The fourth and fifth cyclone units 318 and 320 can be disposed within the third cyclone unit 316. A discharge pipe 376 and a center pipe 392 which may be similar to the discharge pipe 76 and the center pipe 92 of the first exemplary embodiment of the present invention may be disposed within the fifth cyclone unit 320. A first guide member 343 may be disposed at an interior surface of the second cyclone body 353. A second guide member 345 may be disposed at an interior surface of the fourth cyclone body 357. A third guide member 347 may be disposed at an interior surface of the fifth cyclone body 359. The first, second, and third guide members 343, 345, and 347 may guide the air in the second, fourth, and fifth cyclone bodies 353, 357, and 359, respectively. The structure of the cover portion 390 is similar to the cover portion 90 of the first exemplary embodiment of the present invention.

The operation of the dust separating apparatus 309 according to the third exemplary embodiment of the present invention will be explained in detail with reference to FIGS. 9 and 10. The air flows through the first inlet 311, as indicated by an arrow A (shown in FIG. 10). Dust separates from the air while it is swirling along a first cyclone chamber 322, as indicated by an arrow B (shown in FIGS. 9 and 10). The dust drops into a first dust collecting chamber 362. The air flows from the first cyclone chamber 322 into a second cyclone chamber 334, as indicated by an arrow C (shown in FIG. 10). The air swirls while the air is guided by the first guide members 343, as indicated by an arrow D (shown in FIGS. 9 and 10). The dust separated from the second cyclone chamber 334 is discharged to a second dust collecting chamber 364, as indicated by an arrow E (shown in FIGS. 9 and 10). The air flows to the third cyclone chamber 326, as indicated by an arrow F (shown in FIGS. 9 and 10). Fine dust is separated from the air in a third cyclone chamber 326 while the air is swirling, as indicated by an arrow G (shown in FIG. 10). The air is guided by the second guide member 345 to flow to the bottom of a fourth cyclone chamber 328, as indicated by an arrow H (shown in FIG. 10). The fine dust separated in the fourth cyclone chamber 328 is discharged to a fourth dust collecting chamber 368, as indicated by an arrow I (shown in FIGS. 9 and 10). The air flows to a fifth cyclone chamber 330, as indicated by an arrow J (shown in FIGS. 9 and 10). The air is guided by the third guide member 347. The air then sheds dust while swirling, as indicated by an arrow L (shown in FIG. 9). The air is discharged to the exterior by passing through the outlet pipe 376 and a fifth outlet 342, as indicated by an arrow M (shown in FIG. 9).

In the dust separating apparatus of the vacuum cleaner according to the first exemplary embodiment of the present invention, the cyclone units for cleaning are connected in series, so that dust is separated from air sequentially. Therefore, the dust collecting efficiency increases. Additionally, because adjacent cyclone units are disposed within each other, the dust separating apparatus has a reduced height and volume. Also, because the dust receptacle and the cyclone portion are separable from each other, the user can discard dust by separating and carrying the dust receptacle only. As a result, the user can discard collected dust without having to move the entire dust separating apparatus, and thus the dust separating apparatus of the present invention is more convenient than a conventional multi-cyclone dust separating apparatus. Furthermore, the cyclone portion, the dust receptacle, and the cover portion can be formed by injection molding as one body to facilitate the fabrication of these three components. Therefore, mass production is possible.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A dust separating apparatus for a vacuum cleaner, comprising of:

a plurality of cyclone units, the plurality of cyclone units being coupled such that air passes from one cyclone unit to another cyclone unit in sequence, each of the plurality of cyclone units adapted to receive air, swirl the air, and separate dust from the air, wherein each of the plurality of cyclone units is configured to be disposed within another cyclone unit from which it receives the air; and wherein the plurality of cyclone units comprise: a first cyclone unit, a second cyclone unit coupled to receive the air from the first cyclone unit, the second cyclone unit being substantially disposed within the first cyclone unit, and a third cyclone unit coupled to receive the air from the second cyclone unit, the third cyclone unit being substantially disposed within the second cyclone unit.

2. The apparatus of claim 1, wherein each of plurality of cyclone units comprises:

a body;

a cyclone chamber defined within the body and adapted to rotate the air;

an inlet disposed on the body; and an outlet disposed on the body.

3. The apparatus of claim 1, wherein each of plurality of cyclone units comprises a dust collecting chamber wherein each dust collecting chamber is configured to be disposed within another dust collecting chamber.

4. The apparatus of claim 1, wherein the air swirls in a direction opposite to the air swirling in the cyclone unit from which the air is received.

5. The apparatus of claim 1, wherein air is introduced into an upper portion of the first cyclone chamber and discharged through a bottom of the first cyclone chamber, is introduced into a bottom of the second cyclone chamber and discharged through an upper portion of the second cyclone chamber, and is introduced into an upper portion of the third cyclone chamber and discharged through a bottom of the third cyclone chamber.

6. The apparatus of claim 1, wherein air is introduced into an upper portion of the first cyclone chamber and discharged through a bottom of the first cyclone chamber, then introduced into a bottom of the second cyclone chamber and discharged through an upper portion of the second cyclone chamber, and is then introduced into an upper portion of the third cyclone chamber and discharged through the upper portion.

7. The apparatus of claim 1, wherein each of the plurality of cyclone units is formed in a substantially cylindrical shape.

8. The apparatus of claim 1, wherein at least one of the cyclone units is formed in a substantially inverse conical shape.

9. The apparatus of claim 1, wherein at least one of the cyclone units comprises at least one guide member which guides air flowing thereinto.

10. The apparatus of claim 1, wherein a bottom of each of the plurality of cyclone units is disposed on substantially the same plane with respect to each other.

11. The apparatus of claim 1, further comprising:

a cyclone portion housing the plurality of cyclone units;

a dust receptacle detachably coupled to a bottom portion of the cyclone portion; and a cover portion detachably coupled to an upper portion of the cyclone portion.

12. The apparatus of claim 11, wherein the cyclone portion, the dust receptacle, and the cover portion are formed by injection molding as one body.

13. The apparatus of claim 1, wherein the plurality of cyclone units further comprises:

a fourth cyclone unit coupled to receive the air from the third cyclone unit, the fourth cyclone unit being substantially disposed within the third cyclone unit; and a fifth cyclone unit coupled to receive the air from the fourth cyclone unit, the fifth cyclone unit being substantially disposed within the fourth cyclone unit.

14. The apparatus of claim 13, wherein the plurality of cyclone units further comprises:

a first dust collecting chamber detachably coupled to the first cyclone unit;

a second dust collecting chamber detachably coupled to the second cyclone unit;

a third dust collecting chamber detachably coupled to the third cyclone unit;

a fourth dust collecting chamber detachably coupled to the fourth cyclone unit; and a fifth dust collecting chamber detachably coupled to the fifth cyclone unit, wherein the second dust collecting chamber partially encloses an exterior of the second cyclone unit and the fourth dust collecting chamber partially encloses an exterior of the fourth cyclone unit.

15. The apparatus of claim 11, wherein the plurality of cyclone units comprise:

the first cyclone unit forming an exterior of the cyclone portion;

a partition disposed between the first cyclone unit and the second cyclone unit, the partition partially enclosing the second cyclone unit.

16. The apparatus of claim 15, wherein the dust receptacle comprises:

a first dust receptacle body coupled with a bottom of the first cyclone body;

a second dust receptacle body coupled with the second cyclone body and a bottom of the partition;

a third dust receptacle body coupled with a bottom of the third cyclone body; and a discharge pipe disposed within the third cyclone body.

17. The apparatus of claim 16, wherein the first dust receptacle body encloses the second dust receptacle body, and the second dust receptacle body partially encloses the third dust receptacle body.

18. The apparatus of claim 17, wherein the cyclone portion further comprises first and second guide members guiding air flowing into the second cyclone body and the third cyclone body, respectively.

19. The apparatus of claim 11, wherein the cover portion comprises a center pipe adapted to be inserted into the centermost cyclone unit.

* * * * *